United States Patent [19]

Holtrop

[11] Patent Number: 4,466,334

[45] Date of Patent: Aug. 21, 1984

[54] HYDRAULIC AIRCRAFT/STORES CARTRIDGE

[75] Inventor: John W. Holtrop, Ridgecrest, Calif.

[73] Assignee: The United States of America as represented by the Secretary of the Navy, Washington, D.C.

[21] Appl. No.: 356,552

[22] Filed: Mar. 9, 1982

[51] Int. Cl.[3] ..... F15B 15/26

[52] U.S. Cl. ..... 91/45; 92/26; 92/81; 92/108; 244/137 R

[58] Field of Search ..... 92/81, 26, 53, 108, 92/130 A; 91/44, 45, 449, 450; 137/625.22; 89/1.5 R; 244/137 R

[56] References Cited

U.S. PATENT DOCUMENTS

| | | | |
|---|---|---|---|
| 1,864,325 | 6/1932 | Steedman | 92/81 |
| 2,851,995 | 9/1958 | Westcott, Jr. | 92/26 |
| 2,923,278 | 2/1960 | Katzberg | 121/40 |
| 2,970,577 | 2/1961 | Sinclair | 92/81 |
| 3,012,542 | 12/1961 | Miller | 91/45 |
| 3,020,887 | 2/1962 | Hobson | 91/45 |
| 3,186,312 | 6/1965 | Hott | 92/53 |
| 3,871,604 | 3/1975 | Coutin | 244/137 R |
| 3,974,990 | 8/1976 | Holt et al. | 244/137 R |
| 4,050,656 | 9/1977 | Peterson | 244/137 R |
| 4,088,287 | 5/1978 | Hasquenoph et al. | 244/137 R |
| 4,095,762 | 6/1978 | Holt | 244/137 R |

FOREIGN PATENT DOCUMENTS

| | | | |
|---|---|---|---|
| 581833 | 10/1946 | United Kingdom | 92/26 |

*Primary Examiner*—Sheldon J. Richter
*Assistant Examiner*—Randolph A. Smith
*Attorney, Agent, or Firm*—Robert F. Beers; W. Thom Skeer; Kenneth G. Pritchard

[57] ABSTRACT

A hydraulic cartridge suitable for releasing stores in aircraft relies on a pressurized piston rod which extends upon release of hydraulic pressure. The piston rod is enclosed in a cylinder and connected to a source of hydraulic fluid. Upon arming of the piston rod a hydraulic liquid is pumped into the piston rod and forces out a gas via an accumulation piston. Upon complete filling of the piston rod, a trigger is held in place by the pressurized fluid. Upon release of pressure, the pressure on the trigger becomes unbalanced and a spring releases the trigger from the piston rod permitting it to extend.

2 Claims, 8 Drawing Figures

HYDRAULIC AIRCRAFT/STORES CARTRIDGE

BACKGROUND OF THE INVENTION

1. Field of the Invention

The present invention is for hydraulic ejection of stores from aircraft. In particular, the present invention is for the release of stores via hydraulic pistons which extend upon release of pressure.

2. Description of the Prior Art

Numerous aircraft store ejection mechanisms are known. Modern high speed aircraft now use ejection racks powered by pyrotechnic cartridges. The pyrotechnic cartridge provides a predictable large overpressure which provides sufficient pressure to drive piston release mechanisms. The release of stores from high speed aircraft ideally should be done when the store is as far from the aircraft as is practical. This is at odds with the carried configuration of the store where, for aerodynamic purposes, the store is desired to be as close to the aircraft and, if possible, molded into the overall airframe configuration. The release of stores, such as missiles or bombs, close to the airframe permits turbulence to bounce the released store into the aircraft causing structural damage. Thus, modern stores on high speed aircraft are ejected from the aircraft to ensure a safe separation distance when the store enters free flight.

The use of pyrotechnic cartridges provides adequate power to ejector pistons but is unpredictable and cannot be varied in the light of special conditions. The use of pyrotechnics required frequent cleaning of the ejection racks and a new cartridge to be used after each firing. A further complication of such release mechanisms is that fail safe devices are harder to control. The actual pressure in the cartridge only occurs at maximum value when the store is to be ejected. Ideally, if there is going to be a pressure failure in the piston, the pilot of the aircraft would like to know this fact prior to committing an attempted launch of the store. This capability reduces the number of hung stores that could occur on an aircraft in flight.

SUMMARY OF THE INVENTION

A cylinder contained within a cylinder cover and cylinder cap holds a piston rod. The piston rod ends in a series of latches locked against the cylinder by a spring loaded trigger. An accumulation piston within the piston rod permits separation between a gas and a liquid within the piston rod. The center of the piston rod contains an orificed tube which travels from the liquid entrance via the cylinder cap to the bottom of the piston rod where an opening permits the liquid to enter the piston rod.

Prior to activation of the hydraulic cartridge, a gas is fed into the piston rod and charges the piston up to a predetermined gas pressure which moves the accumulation piston to the far end of the piston rod. To arm the system, hydraulic liquid is pumped into the piston rod via the orifice tube and forces the accumulation piston back up the piston rod driving out the gas. Upon completion of the filling process, there is a set pressure within the piston rod. A spring loaded trigger is immersed in the fluid and thus has equal pressure on both sides. At this point, the piston rod is said to be armed. To fire the piston rod and extend it from the cylinder the pressure from the hydraulic liquid source is now switched over to a sump. The sump accepts the release of pressure from the piston rod. As the fluid starts to drain from the piston rod, the pressure across the spring loaded trigger becomes uneven and the greater internal pressure moves the trigger towards the exit path of the liquid. As the spring is depressed the latches are released from being held against the cylinder and the remaining internal pressure extends the piston from the cylinder.

It is an object of the present invention to design an aircraft store ejector that is designed for repeatable use using a hydraulic cartridge. It is a further object of the invention to design a hydraulic store release which permits the operator to determine whether or not the piston is armed for adjustment of the store prior to arming of the store itself. Lastly, it is a further object of the invention to provide for a hydraulic ejection means which releases the store by the release of hydraulic pressure rather than by the increase of hydraulic pressure.

DESCRIPTION OF THE PREFERRED EMBODIMENT

In the following description components shown in more than one figure are referred to by the same numeral.

Figure 1:
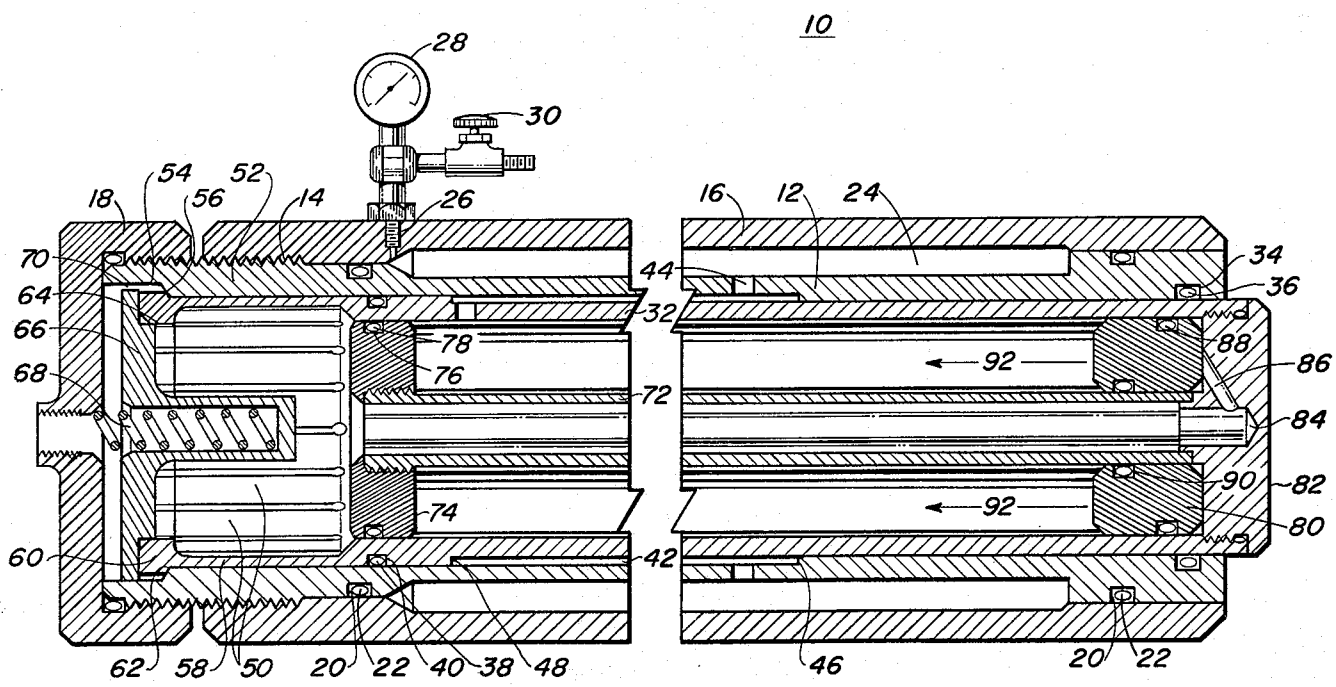
FIG. 1 is a cross section of the present invention.

FIG. 1 is a cross section of the present invention. FIG. 1 contains a hydraulic cartridge shown overall by numeral 10. Hydraulic cartridge 10 has a cylinder 12 which can be made of stainless steel or any other suitable material. At one end of cylinder 12 threads 14 are added to attach a cylinder cover 16 and an orificed cylinder cap 18. To aid in insertion and also to facilitate a tight seal, cylinder 12 has grooves 20 shown one at either end within which O-rings 22 are contained. The exterior wall of cylinder 12 and the interior wall of cylinder cover 16 are contoured as shown to provide a space 24. Mounted through the wall of cylinder cover 16 is a port 26 which is connected to a pressure gauge 28 and a source of pressurized gas, not shown, which enters via fill port 30.

Mounted within cylinder 12 is a piston rod 32. Piston rod 32 is slidably mounted within cylinder 12 by the use of a groove 34 and O-ring 36 contained in the inner wall of cylinder 12 and a groove 38 and O-ring 40 on the exterior surface of piston rod 32. The interior wall of cylinder 12 and the exterior wall of piston rod 32 are sculpted to provide airspace 42 between the two. Access between airspace 42 and airspace 24 is provided by orifice 44 in the wall of cylinder 12. The wall of cylinder 12 has a ledge 46 which serves as a stop on a ledge 48 on the exterior wall of piston rod 32. The mating of ledges 46 and 48 prevents piston rod 32 from any further extension from cylinder 12.

Mounted to the interior end of piston rod 32 are a series of latches 50. Latches 50 are made of a material with sufficient elasticity to cause them to stay pressed against the inner wall of cylinder 12. Threaded end 52 of cylinder 12 has an interior surface 54 with a beveled edge 56. Latches 50 are flat strips 58 throughout most of their length and end in knobs 60. Knobs 60 have a locking edge 62 on their outer surface which rests against the beveled edge 56 of inner wall 54 of base end 52. Knobs 60 have a release surface 64 on the opposite side of locking edge 62.

Figure 7A:
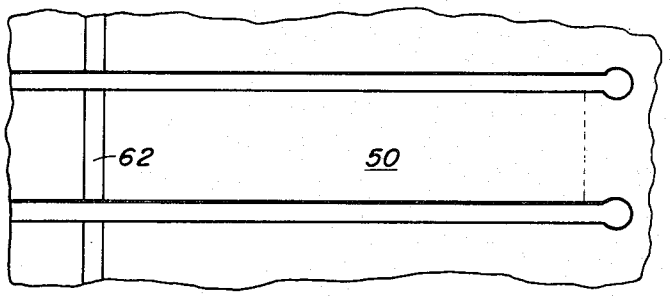
FIGS. 7A and 7B show top and side views of a locking latch.
Figure 7B:
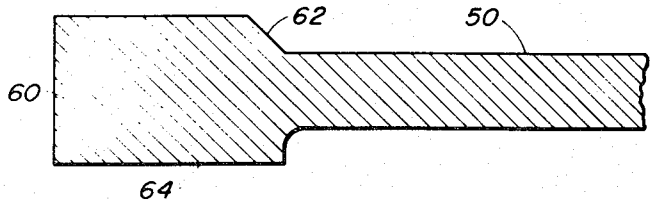

FIG. 7A shows a top view of a latch 50. FIG. 7B shows a side cross sectional view of latch 50. Locking edge 62 and release surface 64 are shown with respect to latch 50 of FIG. 7B.

Knobs 60 are held spread apart by trigger 66. Trigger 66 contains a spring 68 which is set into cylinder cap 18. Spring 68, when extended, forces trigger 66 between knobs 60 and keeps them spread with sufficient pressure to lock knobs 60 against cylinder 12 as previously described. When spring 68 is compressed, trigger 66 moves out of contact with knobs 60 and they compress radially inward freeing piston rod 32. Trigger 66 forms a relatively close seal with cylinder 12 but does not form a perfect seal. Thus, fluid entering cylinder cap 18 seeps around the edges of trigger 66 and flows between the latches. This seepage area is referred to as orifice 70. Once fluid starts entering between the latches, it is restricted to travel down a tube 72 which is centrally mounted within piston rod 32. Tube 72, as shown in FIG. 1, is screwed into an accumulator cap 74 which provides a tight seal through the use of groove 76 and O-ring 78 to the internal wall of piston tube 32.

Surrounding tube 72 is an accumulator piston 80. Accumulator piston 80 slides in a sealing manner along tube 72. It slides from a position adjacent the accumulator cap 74 to a position adjacent a piston cap 82 which is hermetically sealed to the open end of tube 72 and piston rod 32. Piston cap 82 has a bore 84 drilled from its inside center through at least one-half of its thickness and at least one passageway 86 angled back to the inner surface. Tube 72 permits liquid to flow through it and exit the orifice of the tube via passageway 86. Tube 72 is internally threaded to a central opening in accumulator cap 74. On liquid being pumped under pressure down tube 72, accumulator piston 80, which travels on O-rings 88 within grooves 90, slides in the direction of arrows 92 up piston rod 32.

Figure 2:
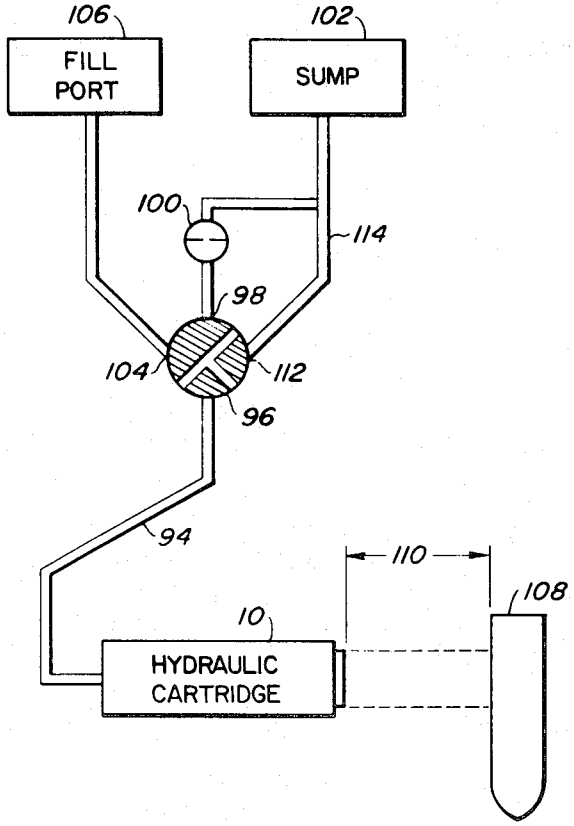
FIG. 2 is a block diagram of the present invention connected to hydraulic circuitry.

FIG. 2 shows hydraulic cartridge 10 connected via tubing 94 to a valve 96. Valve 96 has three positions which correspond to safe, arm, and fire corresponds to the safe position, any build-up of hydraulic pressure in cartridge 10 is bled via tubing 94 through a restricted orifice 100 into a sump 102. This orifice is much smaller than the seepage area 70 surrounding trigger 66. Sump 102 can be the aircraft sump for the hydraulic system on the aircraft. When valve 96 is switched to position 104, a fill port 106 is fed into cartridge 10 and pressurizes cartridge 10 with a hydraulic fluid which is normal hydraulic liquids. Arm mode 104 permits the hydraulic fluid to enter. When it is desired to eject store 108 from the aircraft, the ejection stroke length 110 is initiated by turning valve 96 to the fire position 112. In the fire mode an open line 114 to sump 102 is provided which permits built up pressure in cartridge 10 to backflow through tubing 94, valve 96, and line 114 to sump 102. In summary, the arm position charges the system, e.g., 8,000 psi in 5 minutes. The safe position allows a slow drain of pressure. The fire position causes a rapid pressure drain which triggers the latches.

Figure 3:
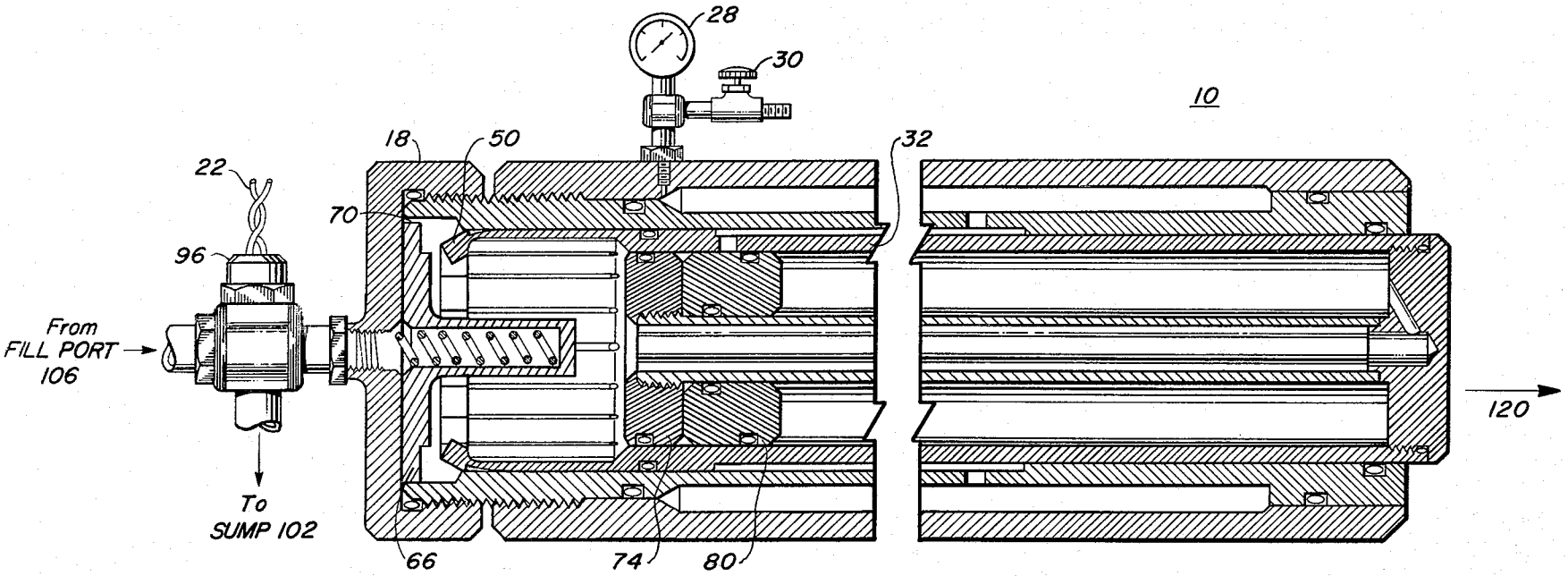
FIG. 3 is a break-away cross section of the present invention.

FIG. 3 shows control valve 96 attached to cartridge 10. When the back pressure is free to drain, trigger 66 is forced to the left, as shown in FIG. 3, and disengages from latches 50. As previously described, latches 50 now retract radially inward and permit smooth passage of piston rod 32 to the right as shown by arrow 120. FIG. 3 shows accumulator piston 80 adjacent to accumulator cap 74. The resultant volume in piston rod 32 is now an oil volume because it is filled with hydraulic oil. In FIG. 1, the safe position is shown and accumulator piston 80 is all the way to the right in piston rod 32 and the volume shown in piston rod 32 is a gas volume similar to gas volume 24. Control valve 96 is usually driven by an aircraft's electrical system prepresented by wire leads 122 which are attached to an electrical source, not shown. The supply arrow in FIG. 3 represents input from fill port 106. The drain arrow represents the common path to sump 102 whether control valve 96 is in safe mode 98 or fire mode 112. For purposes of illustration, tubing 94 in FIG. 3 is represented by the screw thread element screwed directly into cylinder cap 18.

Figure 4:
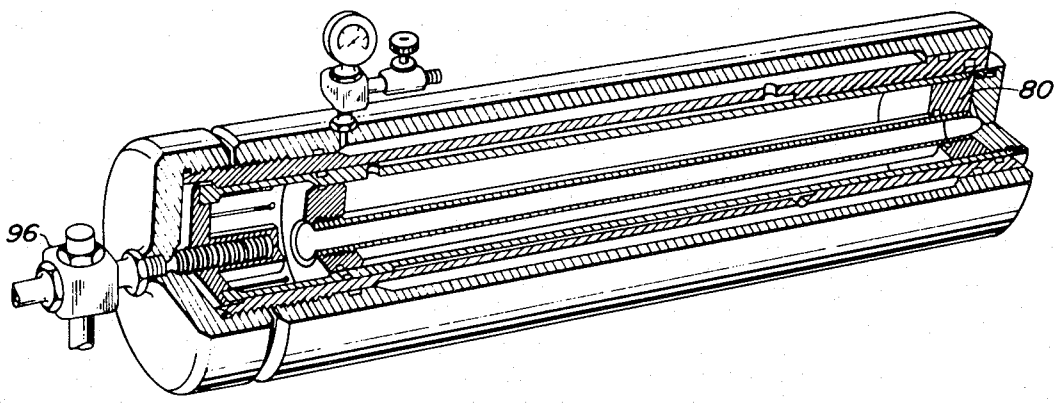
FIG. 4 is a cutaway section of the present invention in the safe position.

FIG. 4 is a breakaway section of the present invention in the safe position. As such, FIG. 4 represents a different view of FIG. 1. Any build-up of hydraulic pressure is immediately drained through valve 96 as shown. The volumes within piston 32 and between cylinder 12 and cylinder cover 16 are gas filled with a predetermined pressure as represented by pressure gauge 28 and fill port 30. Accumulator piston 80 is at its maximum limit to the right in piston rod 32 because of the gas pressure.

Figure 5:
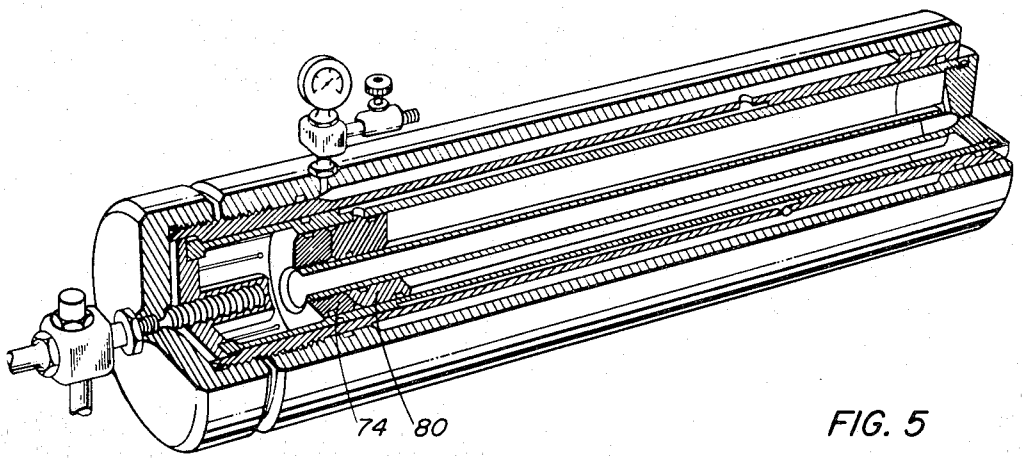
FIG. 5 is a cutaway section of the present invention in the loaded position.

FIG. 5 shows a breakaway of the present invention in the loaded or armed position. Hydraulic fluid is fed under fixed pressures through valve 96 and down tube 72 where it forces accumulator piston 80 back up piston rod until it is stopped by accumulator cap 74. In this position, piston rod 32 has a pressurized oil filled volume.

Figure 6:
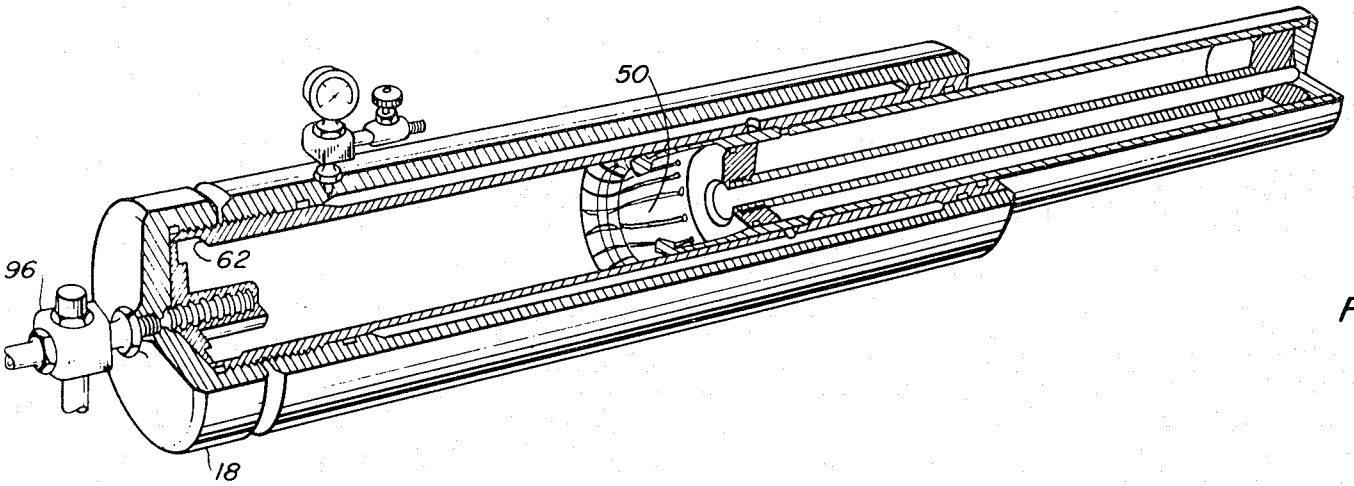
FIG. 6 is a cutaway of the present invention in the fired position.

FIG. 6 shows the present invention in a breakaway view in the fire mode for valve 96. Pressure is now free to drain as shown. Because of the rapid drop of pressure on the external side of cylinder cap 18, trigger 66 is compressed against cylinder cap 18. Latches 50 have been released and removed from beveled surface 62.

If it is desired to safe cartridge 10 after it has been placed in the arm mode, control valve 96 is returned to safe mode 98 and hydraulic fluid is slowly vented through restricted orifice 100. The venting is accomplished at a low enough rate to keep trigger 66 locked against the release surfaces 64.

It is obvious to those skilled in the art that numerous modifications on the above invention can be made.

What is claimed is:

1. A hydraulic cartridge comprising:

a cylinder;

a cylinder cover attached to said cylinder for enclosing a fixed volume between said cylinder and said cylinder cover;

a cylinder cap attached to said cylinder for limiting access of a first fluid to said cylinder except through said cylinder cap;

a piston including a piston rod slideably mounted within said cylinder for extending from said cylinder upon occurrence of specific events;

a tube mounted within said piston, a passageway for passing fluid entering said cylinder cap the length of the piston rod before the first fluid can exit said passageway and enter said piston rod; an orifice in said piston rod;

an accumulator piston slideably mounted within said piston rod and around said tube for compressing a second fluid of preset pressure within said piston rod for forcing said second fluid out of said orifice when said first fluid enters said piston rod;

a means for triggering said piston rod to extend from said cylinder;

means for charging said second fluid in said piston rod to a preset pressure level; and means for pressurizing said piston rod with said first fluid, where said pressurizing means comprises:

a valve with three positions connected to the cylinder cap for setting the first fluid's state in said cylinder and piston to either a "safe", an "arm", or a "fire" state;

a fill port connected to said valve via the "arm" position for filling said piston rod with the first fluid to a desired pressure level;

a sump connected to said valve via the "fire" position for providing a discharge path for said pressurized first fluid in said piston rod; and a restricted orifice passageway connected between the "safe" position of said valve and said sump for bleeding any pressure build-up from said piston rod when the piston rod is not to be triggered.

2. A hydraulic cartridge as described in claim 1 where said triggering means comprises:

a plurality of latches mounted on the internal end of said piston rod; and a spring loaded trigger inserted in said latches and said cylinder cap for locking said latches to said cylinder such that said piston rod cannot extend from said cylinder until said trigger compresses the spring releasing said latches.

* * * * *